US009783402B2

(12) United States Patent
Leibinger

(10) Patent No.: US 9,783,402 B2
(45) Date of Patent: Oct. 10, 2017

(54) VALVE ATTACHMENT, FILLING DEVICE, FILLING ASSEMBLY, AND METHOD FOR FILLING A CONTAINER WITH LIQUID AND DRAINING SAID CONTAINER OF LIQUID

(71) Applicant: Leibinger GmbH, Teningen (DE)

(72) Inventor: Benedikt Leibinger, Freiburg (DE)

(73) Assignee: Leibinger GmbH, Teningen (DE)

( * ) Notice: Subject to any disclaimer, the term of this patent is extended or adjusted under 35 U.S.C. 154(b) by 139 days.

(21) Appl. No.: 14/897,775

(22) PCT Filed: Jun. 11, 2014

(86) PCT No.: PCT/EP2014/001585

§ 371 (c)(1),
(2) Date: Dec. 11, 2015

(87) PCT Pub. No.: WO2014/198413

PCT Pub. Date: Dec. 18, 2014

(65) Prior Publication Data

US 2016/0145089 A1 May 26, 2016

(30) Foreign Application Priority Data

Jun. 11, 2013 (DE) ..... 10 2013 009 766

(51) Int. Cl.
*B67C 3/28* (2006.01)
*B67C 9/00* (2006.01)
*B67C 3/10* (2006.01)

(52) U.S. Cl.
CPC ..... *B67C 3/28* (2013.01); *B67C 3/10* (2013.01); *B67C 9/00* (2013.01)

(58) Field of Classification Search
CPC ..... B67C 3/28; B67C 9/00; B67C 3/10
(Continued)

(56) References Cited

U.S. PATENT DOCUMENTS 5,137,187 A 8/1992 Nichols et al.
2014/0047797 A1 2/2014 Leibinger
2015/0284232 A1 10/2015 Leibinger

FOREIGN PATENT DOCUMENTS

DE 516 739 1/1931
DE 75 36 390 U 4/1976
(Continued)

*Primary Examiner* — Jason K Niesz
*Assistant Examiner* — James Hakomaki
(74) *Attorney, Agent, or Firm* — Gudrun E. Huckett

(57) ABSTRACT

The present invention relates to a valve attachment (2) for filling at least one container (1, 1') with a liquid and draining the at least one container of said liquid, which valve attachment can be tightly attached to the container (1, 1') by means of a bottom side. The valve attachment (2) has a first and a second valve (5, 6), which each have an annular valve seat (7, 8) and each have an annular closing part (9, 10) corresponding thereto, wherein the closing parts (9, 10) are aligned with each other and are designed to surround a specified tubular element (3) in such a way that an annular gap (7', 8') is formed. The first valve seat (7) is stationary and the second valve seat (8) can be moved in a valve longitudinal direction. The closing parts (9, 10) are arranged on a common carrier (11) that can be moved along the valve longitudinal axis. The valve attachment (2) has at least three construction units that are separate from each other, wherein a first construction unit (21'), which is arranged at an end of the valve attachment (2) facing the container (1, 1') to be filled, comprises a first housing part (21) and the valve seat (7) for the valve (5), which valve seat is comprised by the first housing part. The second construction unit (22'), which is arranged at an end of the valve attachment (2) facing away from the container (1, 1') to be filled, comprises a second housing part (22) and the valve seat (8) for the valve (6). The third construction unit (23') comprises the closing parts (9, 10) and the carrier (11). The construction units (21', 22', 23')
(Continued)

can be moved in relation to each other in the direction of the valve longitudinal axis. The invention further relates to a filling device that uses the valve attachment (2) according to the invention, a filling assembly, and a filling method and a draining method in which the device according to the invention is used.

19 Claims, 8 Drawing Sheets

(58) Field of Classification Search
USPC ..... 141/1, 313
See application file for complete search history.

(56) References Cited

FOREIGN PATENT DOCUMENTS

| | | | |
|---|---|---|---|
| DE | 10 2011 100 560 | B3 | 3/2012 |
| DE | 10 2012 021 775 | B4 | 8/2014 |
| EP | 1 340 713 | A2 | 9/2003 |
| WO | 2012/149918 | A1 | 11/2012 |

2
1
3
4

13

2
13
1
3
4

13

VALVE ATTACHMENT, FILLING DEVICE, FILLING ASSEMBLY, AND METHOD FOR FILLING A CONTAINER WITH LIQUID AND DRAINING SAID CONTAINER OF LIQUID

BACKGROUND OF THE INVENTION

The invention concerns a valve attachment for filling and draining at least one container with a liquid in an oxygen-poor atmosphere. Moreover, a filling assembly is disclosed that comprises the valve attachment and therefore also enables filling and draining in oxygen-poor environment. Moreover, a filling assembly that comprises the filling device is subject matter of the invention and, finally, the filling and draining method itself that employs the aforementioned devices.

Valves are known in multiple embodiments. They comprise in principle a valve seat as well as a closure part corresponding therewith. By adjustment of the closure part, the flow rate can be regulated, for example.

For filling a container, in particular a bottle, with a liquid that is intended for consumption, in particular a beverage, the liquid is supplied to the container usually by means of a probe head. The problem in this context is that the liquid is exposed to the ambient air with the result of undesirable gas release, gas exchange as well as gas introduction. The same problem occurs also in connection with non-food applications like medicaments or other chemicals.

Filling devices are known which counteract the afore described disadvantages and for this purpose are provided with a valve attachment, i.e., an attachment that comprises a valve, which comprises a pipe at the bottom and a balloon-like body is pulled over it in a seal-tight manner. The opening of this balloon-like body is seal-tightly connected with the pipe in this context. The thus embodied attachment with its pipe and the balloon-like body is inserted from above into the container to be filled. By supply of an expansion medium such as air through the pipe, the balloon-like body is initially inflated so that it fills out the complete interior of the container. In this way, the container becomes void of air. Subsequently, the expansion medium is then removed again from the balloon-like body. At the same time, the liquid is supplied to the interior that is created thereby in the balloon-like body. Finally, the attachment with the pipe and the balloon-like body can be pulled out again.

Moreover, devices are known for draining, for example, a bottle filled with sparkling wine after bottle fermentation. Here, the general principle resides in that the sparkling wine by addition of $CO_2$ is pressed out of the bottle with excess pressure. The use of $CO_2$ is however undesirable because it dissolves in the sparkling wine upon contact therewith.

For this reason, a device for draining a container has been developed that does not exhibit the afore described disadvantages. The constructive configuration of this draining device corresponds substantially to the afore described filling device. With regard to the method sequence, draining differs however from filling. For draining, first the valve attachment with the pipe arranged therein as well as the balloon-like body is again inserted into the container filled with liquid. By supplying an expansion medium through the pipe the balloon-like body is inflated and the liquid contained in the container is then pressed out through an appropriate opening in the valve attachment. When subsequently the expansion medium is again released, the draining device can be pulled out of the container again.

Based on this prior art, the object of the invention is to improve the valve attachment of the aforementioned kind in particular in such a way that it can be employed for filling a container, in particular a bottle, with fluids, sensitive to oxygen of the air or to carbon dioxide, under an atmosphere that is poor in oxygen or poor in $CO_2$ or under a protective gas atmosphere.

SUMMARY OF THE INVENTION

The technical solution of this object is solved by the valve attachment characterized in that the closure parts of the two valves are arranged on a common support slidable along the longitudinal valve axis, and the valve attachment comprises at least three structural units that are separate from each other, wherein a first structural unit, that is arranged at an end of the valve attachment facing the container to be filled, comprises a first housing part and the valve seat for the valve; a second structural unit, that is arranged at an end of the valve attachment facing away from the container to be filled and that comprises a second housing part and the valve seat for the valve; and a third structural unit comprising the closure parts and the support, wherein the structural units are movable relative to each other in the direction of the longitudinal valve axis.

There is the further object to also fill or transfer $CO_2$-containing beverages into containers under oxygen-poor atmosphere without disadvantageous $CO_2$ absorption.

This object is solved by the filling device that comprises a valve attachment according to the invention, a pipe, and a balloon-like body, wherein the pipe is arranged on the second structural unit of the holding section of the valve attachment and extends, concentrically positioned, through the through opening of the fixed lower section of the holding section and farther through the passages of the annular closure parts and is embodied to project into a position close to a bottom of a given container in an arrangement of use, and wherein the balloon-like body with its closed end is pulled over the free end of the pipe and extends through the valve attachment up to the holding section and is secured therein.

The further object of filling or draining of containers under oxygen-poor or $CO_2$-poor atmosphere or protective gas atmosphere at a predetermined filling level or volume removal is solved by the filling assembly that is characterized in that it comprises at least one filling device according to the invention and a fluid volume compensator, wherein the valve attachment is arranged fluid-tightly on the fluid volume compensator and the fluid volume compensator is arranged fluid-tightly on the container.

An improved filling method is provided by the method with use of a filling or draining device according to the invention, the method comprising the steps of:

- fluid-tightly arranging a container with its fill opening on the bottom of the valve attachment, then inserting the pipe with the balloon-like body pulled over it into the container,
- moving upwardly the second structural unit with valve seat of the second valve and second housing part, thereby lifting the closure part of the second valve and opening the second valve,
- allowing inflow of expansion medium into the balloon-like body, thereby expanding the balloon-like body and displacing fluid out of the container and allowing outflow of the fluid through the open second valve,
- moving upwardly by the same travel the first structural unit with valve seat of the first valve and the first housing part and the third structural unit with the support and the closure parts, thereby lifting the closure part and opening the first valve and closing the second valve, allowing inflow of filling fluid into the container via the first valve through the annular gap of the first valve, upon inflow of the filling fluid, displacing the expansion medium and outflow thereof out of the balloon-like body, continuing inflow of filling fluid until the balloon-like body is completely contracted, lifting of the valve attachment from the container and pulling out the pipe and the balloon-like body pulled over it.

An improved draining method is provided by the method with use of a filling or draining device according to the invention, the method comprising the steps of:

fluid-tightly arranging a container filled with filling fluid with its fill opening at the bottom of the valve attachment, then inserting the pipe with the balloon-like body pulled over it into the container, moving the second structural unit and the third structural unit of the valve attachment with support and closure parts upwardly by the same travel, thereby lifting the closure part of the first valve and opening same, allowing flow of expansion medium into the balloon-like body and expanding same, thereby displacing the filling fluid out of the container, thereby allowing outflow of the filling fluid through the annular gap of the open first valve, moving downwardly the third structural unit and thereby contacting of the closure part of the first valve on the valve seat of the first valve and closing the first valve, thereby lifting the closure part of the second valve from the valve seat of the second valve and opening the second valve, allowing outflow of expansion medium from the balloon-like body, thereby contracting the balloon-like body and compensating pressure.

Preferred embodiments of the devices and of the method are described by the respective dependent claims.

A first embodiment of a valve attachment according to the invention for filling and draining containers with a liquid provides that the valve attachment can be attached with a bottom seal-tightly to the container. In this context, it is understood here that the "container" is either immediately the container to be filled such as a bottle or a fluid volume compensation device is provided as a buffer between bottle and valve attachment and ultimately also forms a container. The valve attachment comprises a first (lower one in relation to the container) and a second (upper) valve that each comprise an annular valve seat as well as, in correspondence therewith, an annular closure part. In this context, the first valve seat is stationary and the second valve seat is provided to be slidable in relation to the longitudinal valve axis. The annular closure parts are aligned with each other and are designed, or at least suitable, to surround a given tubular element with formation of an annular gap. According to the invention, the closure parts of the two valves are arranged on a common support which is slidable along the longitudinal valve axis and the valve attachment comprises at least three structural units that are separate from each other:

a first structural unit which is arranged at an end of the valve attachment that is facing the container to be filled and comprises a first housing part and the valve seat for the valve that is surrounded by it;

a second structural unit which is arranged at an end of the valve attachment that is facing away from the container to be filled and comprises a second housing part and the valve seat (8) for the valve, and finally a third structural unit that comprises the closure parts and the support, wherein the structural units are movable relative to each other in the direction of the longitudinal valve axis.

In this way, it is advantageously achieved that governed and controlled removal of air or liquid contained in the container on separate fluid paths in correspondence with the supply of a liquid or the filling of the container with protective gas or air can be achieved without the material to be removed or to be filled in coming into contact with oxygen. At the same time, the valve attachment in a corresponding filling assembly can quickly and reproducibly perform filling and draining cycles and is suitable for almost all conceivable container types.

The basic idea of the first valve according to the invention for supplying or removing of the liquid in such a filling or draining device resides in that this valve does not supply or remove the appropriate medium at a predetermined defined lateral position but, due to the annular configuration of the valve, the medium is distributed for supply as well as removal about the entire circumference of the pipe or of the balloon-like body. In this way, supply or removal of the medium at one side is avoided. In this context, "medium" is to be understood as meaning the same as fluid; "fluids" in this context can be liquids that are filled into the container; expansion media, in turn, can be all fluids, no matter whether liquids, gases such as air or even inert gases, that are suitable to fill the respective balloon-like body; moreover, in the containers the fluid "air" can be present before filling but also a liquid, other than the desired liquid, that is thus to be drained. On the one hand, in this way the functional safety is increased; on the other hand, the filling or draining speed is increased also. Finally, the configuration of the valve according to the invention also has the advantage that it can be very easily realized with regard to construction. In connection with the filling action of the container, the second valve is provided for escape of the air contained in the container as well as for supply of air in connection with the draining action of the container; the valves can also be connected in reverse. The proposed configuration of the valves is a constructively simple possibility that enables for both valves to configure the appropriate connecting parts separate from each other but on the common support for common actuation. Since this support is movable along the pipe, the valves can open and close according to an appropriate displacement movement.

In order to achieve this, in one embodiment of the invention it is provided that the closure parts of the two valves and the support are arranged non-slidably relative to each; they can also be embodied as one piece. In this way, a coupled actuation of the first and the second valve with a common actuation element is enabled; the closure parts and the support can engage each other, for example, in a form-fit way. Moreover, in case of a multipart configuration a simple assembly of the valve attachment is advantageously possible.

In a further embodiment, the valve attachment can be provided at the second structural unit with a holding section that is designed to hold a given tubular element concentric in the passages of the annular closure parts. The holding section can comprise a lower section that is fixed relative to the second structural unit and provided with a through opening for a tubular element and an upper section that is detachably connected with the lower section and comprises a bore for receiving the tubular element. Expediently, the through opening is aligned with the passages of the annular closure parts and in the through opening a clamping body is seated which is preferably supported by means of a spring against the upper section in order to force the clamping body against the passage and to achieve the clamping action. In the bore of the detachable section of the holding section, the pipe is advantageously supported with little play while the pipe in the through opening of the stationary section of the holding section can have a noticeable radial play.

The two valves can be conical valves. Moreover, the first valve and/or the second valve can be surrounded by an annular space concentrically relative to the pipe for storage of the respective medium. This means that the closure parts are conically configured while the corresponding valve seats comprise a conical depression into which the corresponding conical closure parts during the sealing process are immersed in a seal-tight way.

An annular space correlated with each of the two valves and surrounding them, respectively, serves for storing of the corresponding medium (liquid or air or inert gas) about the valve. In this way, a uniform supply or removal of the medium about the entire circumference of the rod or the balloon-like body can be achieved.

The closure parts of the two valves are sealed relative to the respective correlated structural units so that no fluid can escape into the housing. The sealing action can be achieved by a respective sealing bellows that follows a relative movement of the closure parts relative to the structural units. Due to the sealing action, it can also be prevented that slide rails or the like on which the support is moved can become soiled or worn.

In an embodiment according to the invention of a filling device for filling a container with liquid or for draining a liquid from a container, it is provided that the filling device comprises a valve attachment as described above, moreover a pipe, and a balloon-like body. Accordingly, the liquid must not be immediately removed from the container or filled into it by the valve but can be handled in an improved way by means of the following configuration in accordance with the invention: For this purpose, the pipe is arranged at the second structural unit of the holding section of the valve attachment and extends, concentrically positioned, through the through opening of the fixed lower section of the holding section and further through the passages of the annular closure parts. It is embodied so that it extends close to a bottom of a given container in an arrangement of use. The balloon-like body is pulled with its closed end over the free end of the pipe and extends through the valve attachment into the holding section in which it is secured. In the following, the device for filling or draining of a container we referred to also as a filling device but the following descriptions relate likewise to the draining device.

In relation to the statement "close to the bottom", it is to be mentioned that such a spacing is to be maintained that the pipe upon insertion into the container is placed so far spaced away from its bottom that neither the bottom nor the balloon-like body will be damaged.

Since in regard to manufacture small differences in wall thickness of the bottom can occur in case of bottles and since insertion of the pipe is realized always to the same extent, the maximum insertion depth must be adjusted taking into consideration these differences. In order to be able, in spite of this, to insert the pipe—also referred to as rod or as a tubular element—to such an extent that the balloon-like body upon uniform expansion or unfolding reaches the inner wall (inner wall surface) of the container on all sides, including the bottom, a distance adaptation device can be arranged at the lower end of the pipe. Such a device is disclosed in the corresponding context in DE 10 2012 021 775 A1, reference being had to it and it being incorporated by reference herein in its entirety. The device therein for filling or for draining a container with liquid has a rod arranged in a holder and a balloon-like body, liquid-tight relative to liquid and gas-tight, envelopes the rod. The rod (herein the pipe) therein is also insertable with the balloon-like body into an opening of the container and, after complete insertion, the holder is secured on or in the opening of the container (herein "secured" is to be understood as "positioned"). After insertion, the balloon-like body is filled and inflated with an expansion medium in such a way that it contacts the inner wall surface of the container. The spacing between the lower end of the rod and the upper holder, depending on the spacing between the lower bottom and the upper opening of the container, is automatically changeable, which can be achieved by telescoping action of the rod or by means of an extension sleeve that is in particular guided within the rod and is longitudinally slidable or pushed over it. Also, a post can be guided within the rod or the pipe. The present case always concerns a pipe for guiding fluid; the sleeve solution and the post solution are both possible, in particular with spring action.

In a further embodiment, the balloon-like body is fluid-tightly fastened in the through opening of the holding section by means of a clamping body which is supported preferably by a spring against the upper section of the holding section. Due to this arrangement, the balloon-like body is seated safely on the pipe even when pressure is acting on the balloon and causes it to expand or to unfold.

Configuring the balloon-like body with the pipe and with the upper section of the holding section as a detachable unit is a very clever embodiment because the balloon, that allows for approximately 5,000 filling cycles, can be exchanged easily and with minimal time expenditure when damaged in that simply the upper section of the holding section is detached. Then the damaged balloon-like body is pulled off the pipe and a new one is pushed on and the detachable unit is then inserted again. This can be realized particularly easily when the upper section has a bore in which the pipe is received and the pipe extends through the one bore in upward direction and is received non-detachably in a fastening socket. The latter, in turn, can then be coupled detachably with a fluid source, for example, a gas source.

For an especially suitable attachment of the upper end of the balloon-like body, the through opening at its inner side can comprise a cone tapering in the direction of the second housing part and the clamping body can be a clamping ball or a clamping cone; they interact with each other such that they clamp the outer end of the balloon-like body that is pulled over the clamping body in the clamping cone while the pipe extends through the clamping body or a bore provided therein.

The balloon-like body which can be used with the devices according to the invention but also with other devices can be formed by a hose of a thermoplastic elastomeric material such as preferably a TPE extrudate that is closed off at one end. Advantageously, these hoses can be manufactured inexpensively and inert with regard to many of the substances subjected to the filling action. The closure of the hose can be produced by an end member, preferably a cylindrical end member, particularly preferred a cylindrical PE end member, that is fused to the hose material and is inserted into the hose end. The hose can however be closed also in other ways. The hose should have at least one, preferably a plurality of flow channels on its outer wall surface, which is achieved e.g. by one or several longitudinal webs or longitudinal grooves along its length. The cross-sections of the webs or grooves can be polygonal or round in this context; it is important that they space apart the outer surface of the balloon-like body in the expanded state from the inner wall of the container to just about such an extent that, for a maximum volume utilization and thus air displacement or fluid displacement, there are still flow channels remaining in the container. The more flow channels are present the safer the positioning in relation to the valves through which the fluid is to flow. Therefore, at least one flow channel must correspond with the geometry of the annular gaps such that at least one fluid path or two fluid paths are provided.

The balloon-like body can also be formed of a non-elastomeric material. Then it is present as a body which is not open at its lower end and, for the aforementioned reason, has also one or several longitudinal webs and/or longitudinal grooves. It comprises a hose-like section whose inner diameter and length correspond to an outer diameter of a pipe that is predetermined for use in the filling device according to the invention so that the hose-like section can be pulled without play over the pipe and a section capable of unfolding that has a shape designed to contact in the unfolded state the inner wall of the container.

A further device according to the invention is the filling assembly for filling a container or for draining a liquid from a container that comprises the aforementioned filling device and additionally a fluid volume compensator on which the valve attachment is arranged and which itself is arranged on the container that is to be ultimately filled or drained.

The filling or draining device according to the invention is used for a filling process for a container as follows:

a) fluid-tightly arranging a container with its fill opening on the bottom of the valve attachment, then inserting the pipe with the balloon-like body that has been pulled over it into the container;

b) upwardly moving the second structural unit with valve seat of the second valve and second housing part, thereby lifting the closure part of the second valve and opening the second valve;

c) allowing expansion medium to flow into the balloon-like body, thereby expanding the balloon-like body and displacing fluid from the container and allowing the fluid to flow out through the open second valve;

d) moving upwardly by the same travel the first structural unit with valve seat of the first valve and the first housing part and the third structural unit with the support and the closure parts, thereby lifting the closure part and opening the first valve and closing the second valve;

e) allowing filling fluid to flow into the container via the first valve through the annular gap of the first valve;

f) as the filling fluid flows in, displacing the expansion medium and allowing it to flow out of the balloon-like body, continuing inflow of the filling fluid until the balloon-like body is completely contracted;

g) lifting the valve attachment from the container and pulling out the pipe and the balloon-like body pulled over it.

The fluid-tight "connection" of the container with the valve attachment can be realized directly or indirectly, depending on whether a volume compensator is used that is then essentially to be understood as the container.

In a further embodiment of the method, a device with volume compensator is provided. It is then provided that in the step a) the fill opening of the container is connected seal-tightly with a bottom of the fluid volume compensator;

and in step f) a compensation volume of the fluid volume compensator is filled with the filling fluid. Further it is provided that in step g), upon pulling out the pipe and the balloon-like body pulled over it, the compensation volume is allowed to flow out of the fluid volume compensator into the container, thereby compensating a displacement volume of the pipe and of the balloon-like body.

In analogy, with the filling or draining device according to the invention a draining method can be performed with a fluid-filled container with the steps of:

a) fluid-tightly arranging a container filled with fluid with its fill opening on the bottom of the valve attachment, then inserting the pipe with the balloon-like body pulled over it into the container;

b) moving upwardly by the same travel the second structural unit and the third structural unit with valve attachment with support and closure parts, thereby lifting the closure part of the first valve and opening the same;

b) allowing expansion medium to flow into the balloon-like body and expanding it thereby, and displacing the fluid out of the container, thereby allowing the fluid to flow out through the annular gap (9') of the open first valve;

c) moving downwardly the third structural unit and thereby contacting of the closure part of the first valve on the valve seat of the first valve and closing of the first valve, thereby lifting the closure part of the second valve from the valve seat of the second valve and opening the second valve;

d) allowing expansion medium to flow out of the balloon-like body (3), thereby contracting the balloon-like body and compensating pressure.

By use of a fluid volume compensator which is connected fluid-tightly with the bottom of the valve attachment, in step a) the fill opening of the container (1) is connected seal-tightly with a bottom of the fluid volume compensator and in step b), when allowing the balloon-like body to expand, filling of a compensation volume of the fluid volume compensator with the fluid to be drained occurs; subsequently, the balloon-like body is allowed to expand into the compensation volume (wherein, depending on the choice of the balloon-like body, expanding can also mean unfolding) so that the fluid to be drained is displaced completely out of the fluid volume compensator.

BRIEF DESCRIPTION OF THE DRAWINGS

Further embodiments as well as some of the advantages which are associated with these and further embodiments will become apparent and easily understood by the following detailed description with reference to the attached drawings. Articles or parts thereof which are substantially identical or similar can be provided with the same reference characters. The Figures are only a schematic illustration of an embodiment of the invention. It is shown in.

DESCRIPTION OF PREFERRED EMBODIMENTS

Figure 1A:
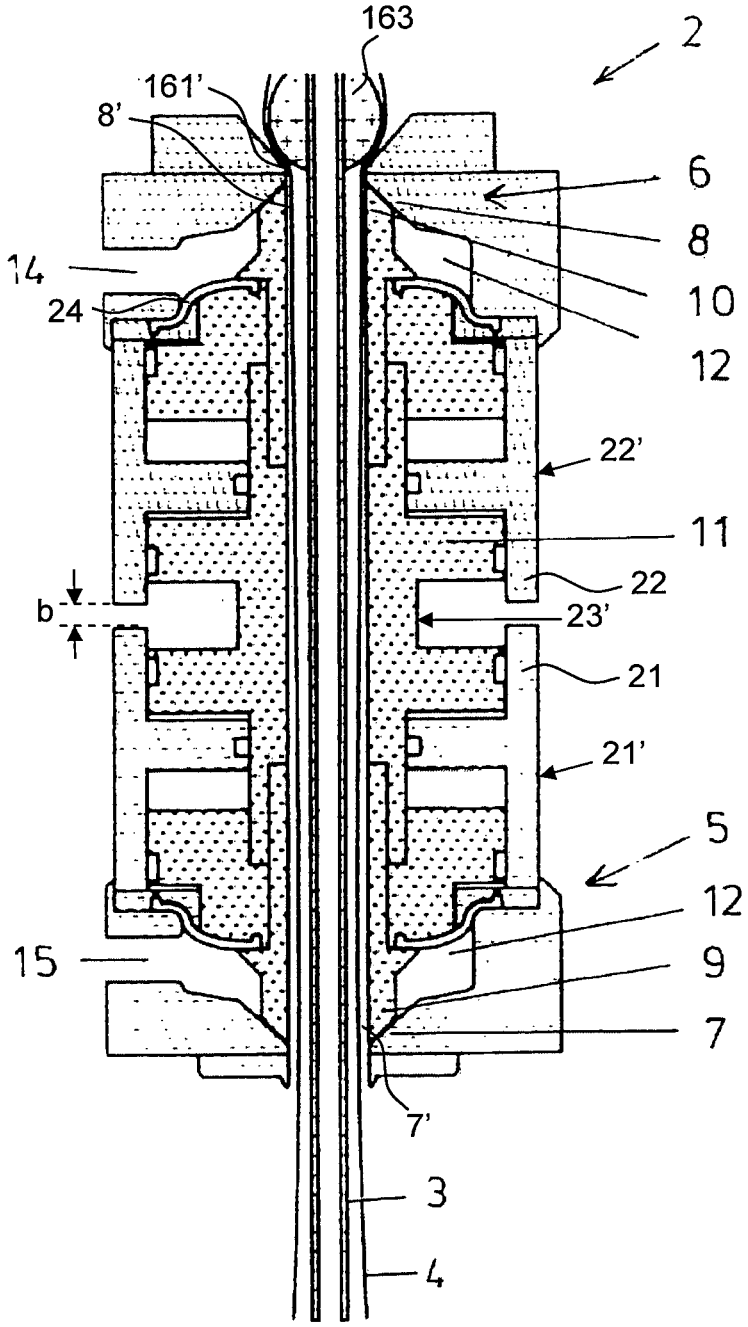
FIG. 1*a* a section view of the valve attachment in closed state.
Figure 1B:
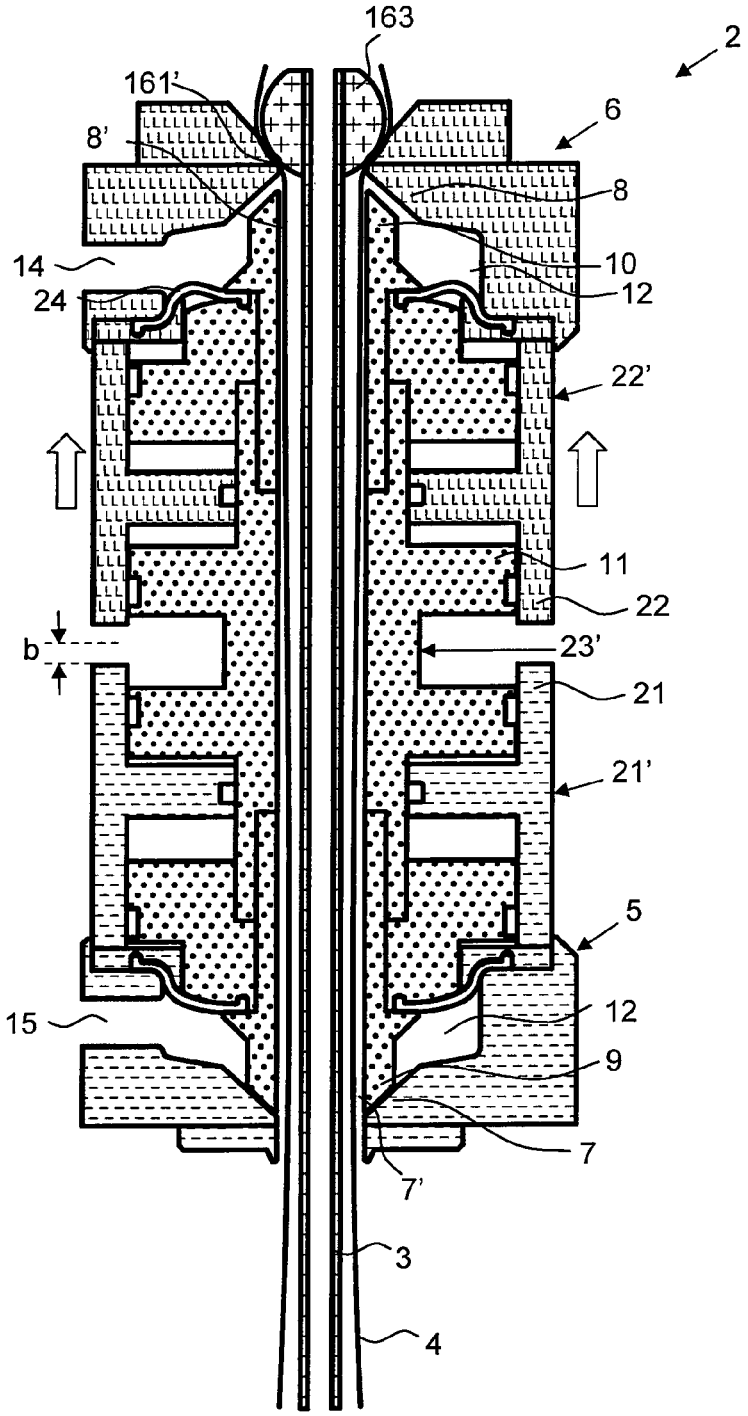
FIG. 1*b* an illustration corresponding to that in FIG. 1*a* wherein the valve for air is open.
Figure 1C:
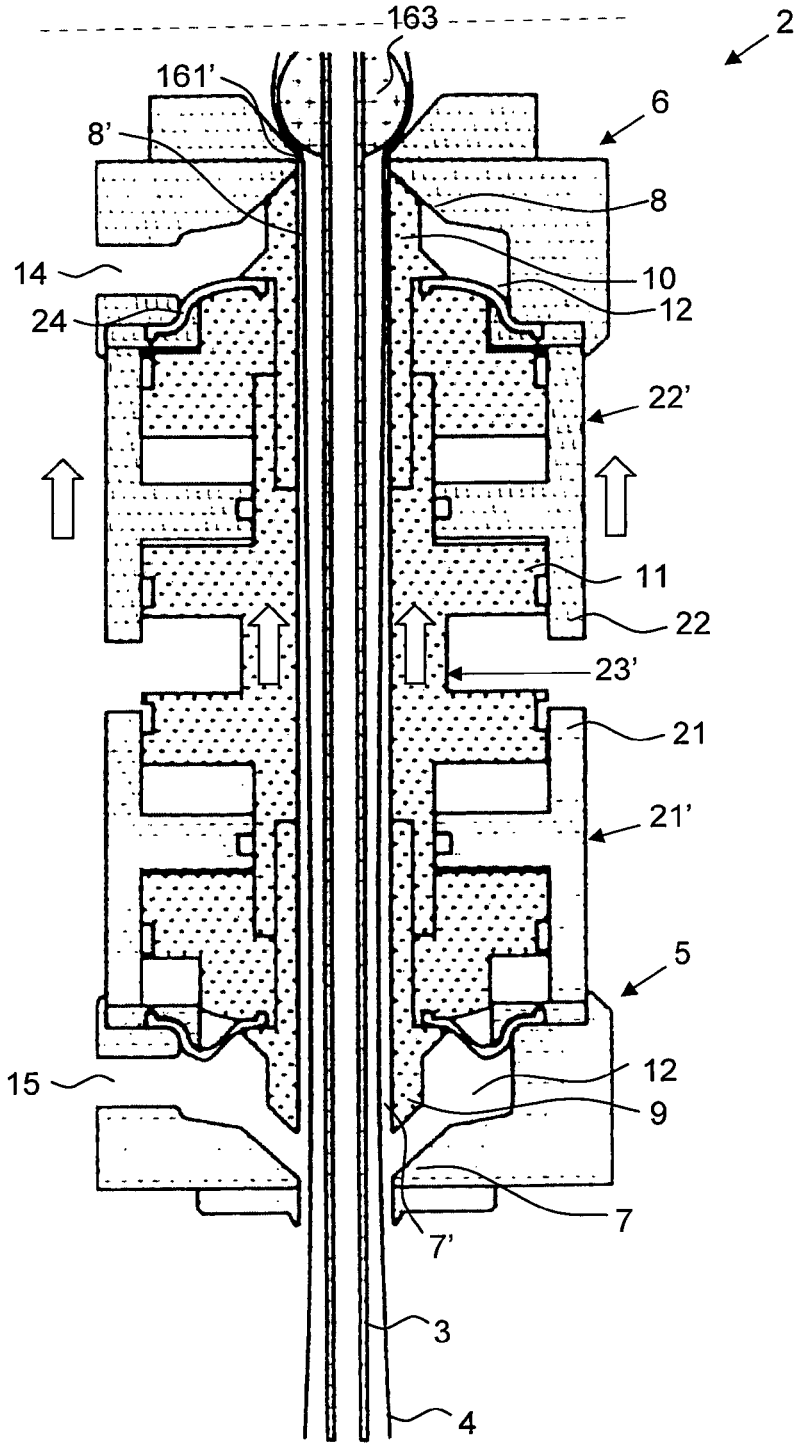
FIG. 1*c* an illustration in accordance with those of FIGS. 1*a* and 1*b*, wherein the valve for the air is closed and the valve for the liquid is open.

The filling or draining device according to the invention, whose basic principle is illustrated in FIGS. 1*a* to 1*c*, will can be employed for filling as well as for draining a container. Draining can be, for example, necessary when a transfer is required in connection with bottle fermentation. Filling can mean any filling of liquid into a container such as a bottle but also in principle other containers. In the illustrated Figures a bottle 1 is illustrated.

The filling or draining device according to the invention is placed in FIGS. 2*a* to 2*d* seal-tightly onto the bottle 1 (as is also shown in FIGS. 3*a* to 3*d*).

The filling or draining device comprises a valve attachment 2 and a pipe extended therethrough with a balloon-like body 4 pulled over it. In this context, the pipe 3 is projecting at the bottom out of the valve attachment 2. The valve attachment 2 is designed such that it the with its bottom is seal-tightly seated on the bottle 1 (see FIGS. 2*a-d* and FIGS. 3*a-d*) when the latter is directly filled or on a volume compensator 1' (see FIG. 4) when the bottle is "indirectly" filled. At an upper end area of the pipe 3, the balloon-like body 4 is connected fluid-tightly with the pipe 3. Here, a ball 163 is connected with the pipe 3 or pushed onto the pipe 3 wherein the balloon-like body 4 is pulled over the ball 163. The ball 163 is seated in this context in a through opening 161' and the balloon-like body 4 is clamped between the ball 163 and the upper rim of the through opening 161'.

The balloon-like body 4 can be a hose that is formed of a thermoplastic elastomeric material, for example, a TPE extrudate, that is closed off at its lower end (i.e., the end that is provided for positioning in the container to be filled or drained). Closure can be realized by means of an end member, for example, a PE end member, that can be welded to the hose material. A cylindrical end member is advantageous because it can be inserted without problem into the hose end and welded therewith. The hose in its non-expanded shape has an inner diameter that corresponds to the outer diameter of the pipe 3. Its material properties with regard to wall thickness and elasticity are selected such that the hose expanded by inflation assumes a balloon shape which fills out the interior volume of the container to be filled or of the bottle to be filled and optionally the upstream pressure compensator (see FIG. 4). An extruded hose is particularly suitable when longitudinally extending webs or grooves are provided on the outer side of the balloon-like body 4 because they can be produced essentially without additional costs. The grooves or webs are provided, as explained above, in order to provide flow channels and to enable in this way a complete drainage of a container without formation of "liquid bubbles" or "gas bubbles" between balloon-like body 4 and container wall.

It is however also possible that the balloon-like body 3 is a simple balloon that is closed off at the end, i.e., is not open. The balloon-like body 4 can be a body that is not open at its lower end and is formed of a non-elastomeric material. The latter has a hose-like section that has unchangeably an inner diameter that corresponds to the outer diameter of the corresponding given pipe 3 and therefore surrounds the latter in a flush arrangement, and it has a section that can be unfolded that is like a pocket that can be unfolded and has a shape that corresponds to the inner shape of the container. This section can be of a very strong, thin-walled material and is located during the filling or draining process in the interior of the container. As in the case of the hose, on the outer side of the non-open balloon-like body longitudinal webs are present which extend from the lower end of the non-open body up to the upper one of the two valves or past it.

Upon expansion of the balloon-like body 4, the latter does not only line the container completely but also the interior of the valve attachment 2, i.e., the balloon-like body 4 contacts inwardly the through bore of the support 11 or of the closure parts 9, 10 and the valve seats 7, 8. Accordingly, the valve attachment 2 can also be freed completely from ambient air prior to filling so that here also the filling fluid does not come into contact with ambient air.

Figure 5:
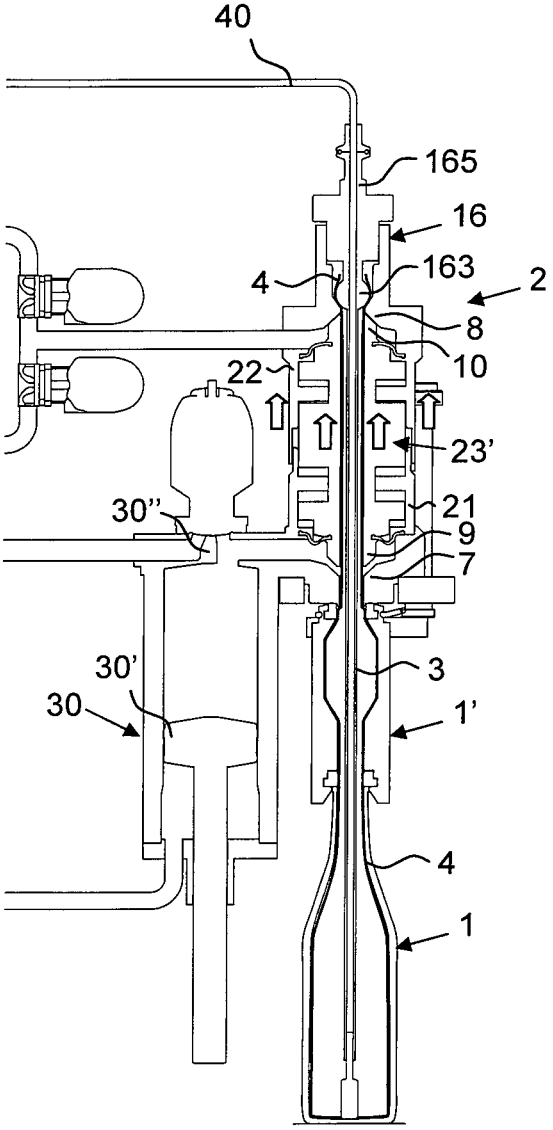
FIG. 5 a device schematic in the state prior to filling the container.

The valve attachment 2 that in principle can also be used in filling devices other than the one according to the invention shows in FIGS. 1*a* to *c* but also in FIG. 5 a first valve 5 and a second valve 6 with a respective annular valve seat 7, 8 as well as, corresponding thereto, an annular closure part 9, 10. The first valve seat 7 is fixed relative to a container to be filled and the second valve seat 8 is slidable in relation to a longitudinal valve axis. The two closure parts 9, 10 are aligned with each other and surround the pipe (3) with formation of a respective annular gap 8', 9'. The closure parts 9, 10 of the two valves 5, 6 are arranged on a common support 11 which is movable along the longitudinal valve axis wherein the unit of the closure parts 9, 10 and of the support are referred to as third structural unit 23'. The valve seat 7 of the lower valve 5 and the correlated housing part 21 are referred to as "first structural unit 21'". The second structural unit 22' refers to the valve seat 8 of the upper valve 6 and its correlated housing part 22.

The structural units 21', 22', 23' can be moved relative to each other along the longitudinal valve axis in order to open valves 5, 6 individually or both valves 5, 6.

The movement sequence for opening the upper valve 6, which here is the air valve, is illustrated in FIG. 1*b*. For this purpose, the second structural unit 22' that comprises the component with the valve seat 8 of the upper valve 6 and the second (upper) housing part 22 is moved in the direction illustrated by arrows along the longitudinal valve axis so that the valve seat 8 lifts off the closure part 10 and an opening cross-section becomes available so that the valve is open. In this state, ambient air but also any other gaseous or liquid medium can flow in or out through the annular gap 8' that is located between the valve seat 8 and the outer wall surface of the balloon-like body 4. The ambient air is supplied to or discharged from the valve 6 via the bore 14 and the annular space 12 adjoining it. The bore 14 and the annular space 12 are sealed relative to the support 11 by a sealing bellows 24 so that no ambient air or other fluid can escape. This is in particular important when the filling or draining process is carried out with high differential pressures. The movement of the second structural unit in the direction of the longitudinal valve axis is illustrated in this context by the spacing b that corresponds to the spacing of the first housing part 21 from the second housing part 22 in the closed state of FIG. 1*a*.

The movement sequence for opening the lower valve 5 since here the liquid valve is located is illustrated in FIG. 1*c*. In this context, the second structural unit 22', comprising the component with the valve seat 8 and the second (upper) housing part 22, and the third component unit 23', comprising the closure parts 9, 10 and the support 11, are displaced by the same amount in the direction indicated by the arrows along the longitudinal valves axis so that the closure part 9 of the lower valve 5 is lifted off its valve seat 7 and the valve is opened. The upper valve 6 (here air valve) remains closed. Accordingly, flow through the valve 5 in/from the annular space 12 and the bore 15 is possible. At the bottom a sealing action of the annular space 12 surrounding the valve seat 7 relative to the support 11 by means of a sealing bellows 24 is also present so that the slide surfaces of the support 11 relative to the housing part 21 or relative to the component that comprises the valve seat 7 cannot come into contact with the filling fluid and cannot be contaminated and no germ hot spots can form.

Figures 2A, 2B, 2C, 2D:
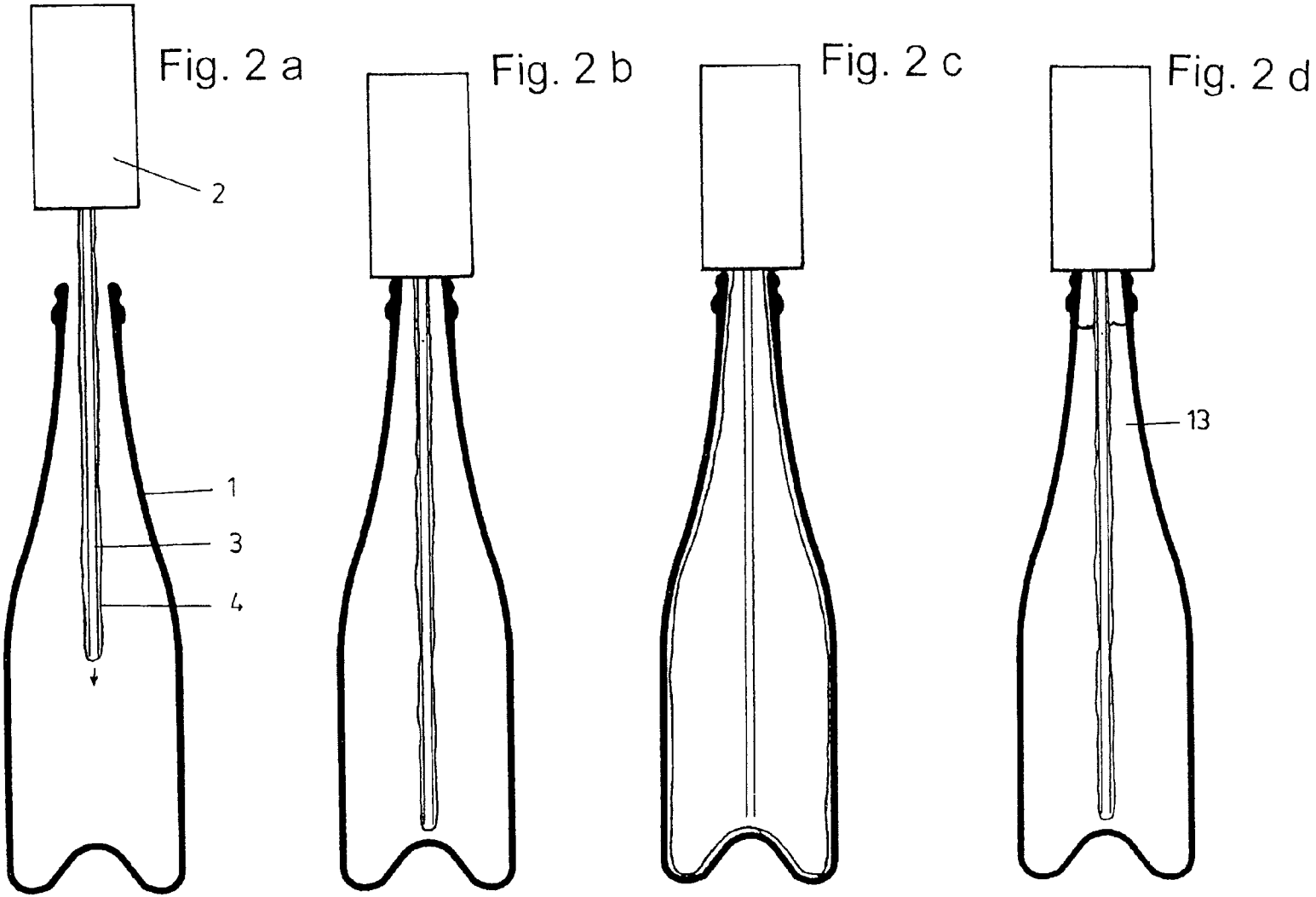
FIGS. 2*a* to 2*d* the method sequence for filling a bottle.

The function when filling the container 1 with a liquid 13 is as follows (FIGS. 2*a* to 2*d*):

First, the attachment 2 is placed from above onto the empty container 1 in the form of a bottle and the pipe 3 together with the balloon-like body 4 pulled over it is inserted so that the attachment 2 with its bottom is resting seal-tightly on the upper bottle neck (FIGS. 2*a* and 2*b*). Now the air valve (second upper valve 6) of the valve attachment 2, as disclosed in FIG. 1*b*, is opened. Subsequently, the balloon-like body 4 is inflated with an expansion medium (in particular sterile compressed air) in such a way that this balloon-like body 4 fills out the entire interior of the container 1 (FIG. 2*c*). The supply of expansion medium is realized in this context by means of the pipe 3. Instead of filling the balloon, it is also possible to evacuate the container in order to "pull" the balloon against the inner wall surface.

In that the balloon-like body 4 fills out the entire interior of the container 1, the air contained therein must escape. For this purpose (as illustrated in FIG. 1*b*) the second valve 6 is opened. The displaced air is then discharged upon inflating the balloon-like body 4 via the annular space 12 and the bore 14. In order for all of the air to escape from the container 1 during gradual inflation of the balloon-like body 4 so that no "air bags" are formed, the surface of this balloon-like body 4 is preferably profiled in longitudinal direction, i.e., comprises webs or grooves.

Subsequently, the liquid 13 can be supplied to the container 1. For this purpose, the upper second valve 6 is closed again and the lower first valve 5 is opened wherein the sequence for opening the lower valve 5 is described in regard to FIG. 1*c*. Via bore 15 and the annular space 12 the filling fluid 13 is supplied to the lower first valve 5 and flows finally through the annular gap 9' between the wall surface of the balloon-like body 4 and the valve seat 7 into the container 1. The filled container 1 is illustrated in FIG. 2*d*.

Subsequently, the filling device with its attachment 2, the pipe 3, and the balloon-like body 4 can be pulled out again.

The function for draining the container 1 filled with a liquid 13 is as follows (FIGS. 3*a* to 3*d*):

Here also, first the attachment 2 with its bottom is placed seal-tightly onto the opening of the container 1 and is inserted with its pipe 3 and the balloon-like body 4 into the container 1 filled with a liquid 13.

Figures 3A, 3B, 3C, 3D:
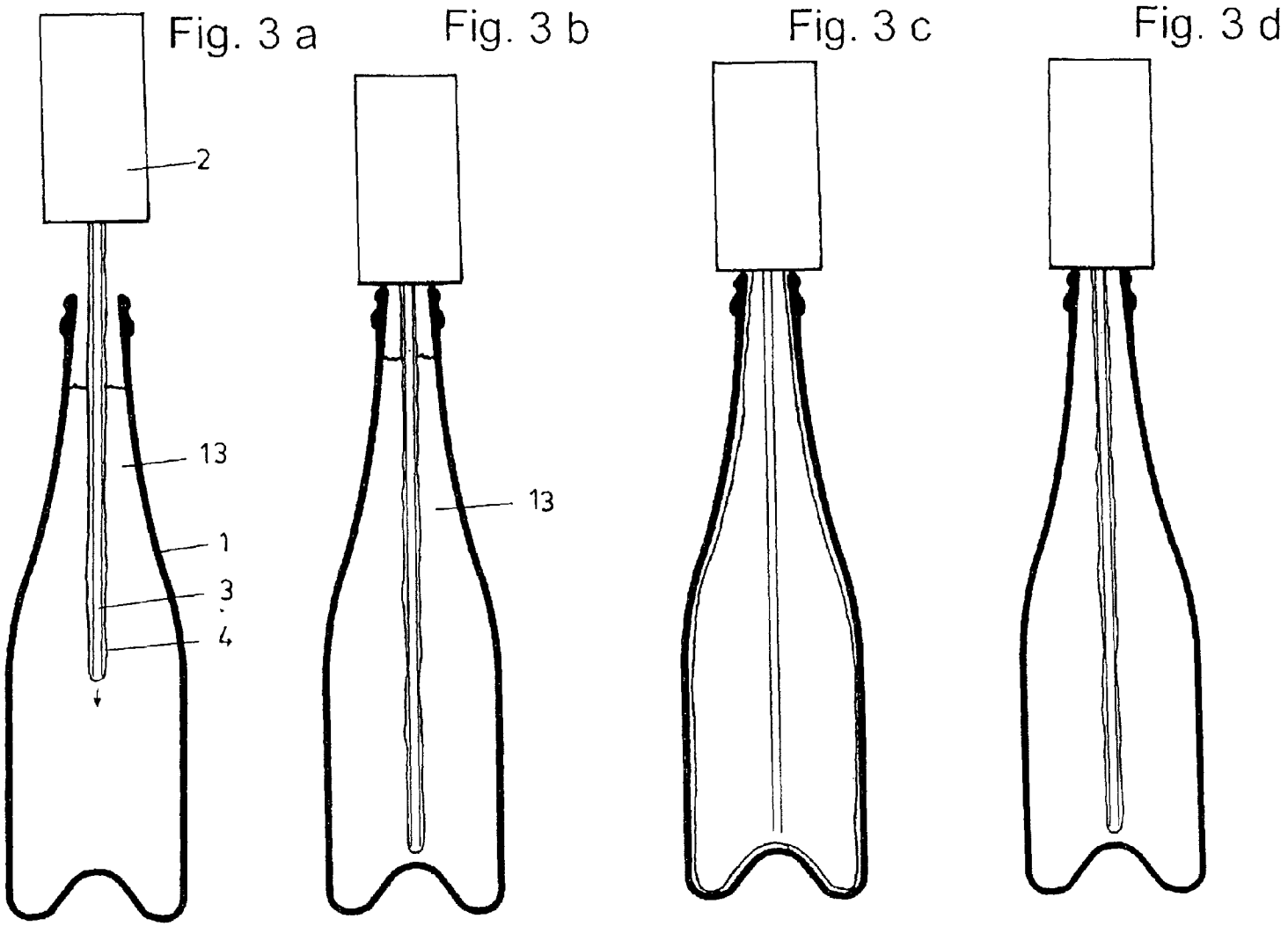
FIGS. 3*a* to 3*d* the method sequence for draining a bottle.

First, the lower first valve 5 which is the liquid valve is then opened as disclosed in FIG. 1*c*. Subsequently, the balloon-like body 4 is inflated with an expansion medium which is supplied through the pipe 3. By the pressure on the liquid 13 which is contained in the container 1, this liquid 13 is forced out through the lower first valve 5. In this context, the liquid 13 flows first through the annular space 12 and flows then out via the bore 15. In FIG. 3*c* it is illustrated that the balloon-like body 4 completely fills out the container 1 and all liquid 13 has thus been pressed out. In order for all liquid 13 to flow out of the container 1, the surface of the balloon-like body 4 is preferably profiled, in particular profiled in longitudinal direction.

Subsequently, the expansion medium is again discharged from the balloon-like body 4 so that the latter returns into its initial state (FIG. 3*d*). However, during contraction of the balloon-like body 4, the upper second valve 6 which is here an air valve must be opened so that ambient air or any other gas can flow into the bottle in order to produce pressure compensation. The movement sequence of the valve attachment 2 for opening the upper second valve 6 is disclosed in connection with FIG. 1*b*.

Figure 4:
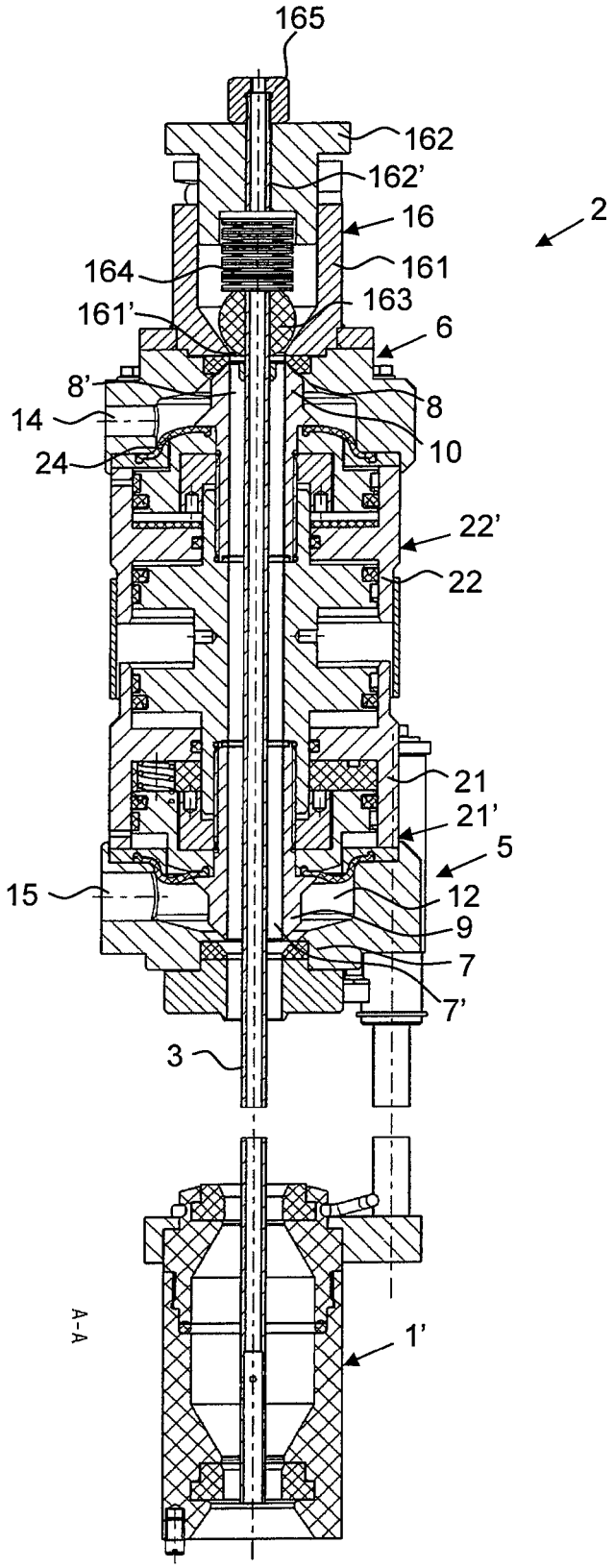
FIG. 4 a longitudinal section view of a filling device with volume compensator.

The valve attachment 2 can be placed either directly onto a bottle or onto a similar container 1 that is to be filled (see FIGS. 2*a-d*, FIGS. 3*a-d*) or "indirectly" via a volume compensator 1' which is essentially also a "container to be filled". This is illustrated in FIG. 4. The volume compensator 1' is lined by the balloon-like body and is filled and emptied with the method.

In FIG. 4, the balloon-like body 4 (see, for example, FIG. 5 and FIG. 6) is however not shown. The latter is pulled over the pipe 3 from the side which is facing the container to be filled and extends to an upper end area of the pipe 3, i.e., an area facing away from the container. Here a clamping ball 163 is provided by means of which the balloon-like body is sealed fluid-tightly relative to the pipe 3. For guiding the pipe 3 in axial direction, a holding section 2 is provided which is arranged at the upper end of the second structural unit 22', more precisely on the component that comprises the valve seat 8 of the second valve 6.

The holding section 16 is comprised in this context of two individual parts, a lower section 161 which is fixedly secured relative to the second structural unit 22' and a removable upper section 162 which comprises a receiving bore 162' in which the pipe is supported with little radial play. The lower fixedly secured section 161, on the other hand, has a through opening 161' through which the pipe 3 is guided wherein the pipe 3 has a considerable radial play therein. The clamping body 163 is resting on the upper rim of this through opening 161'. It is provided to clamp the balloon-like body between the clamping body and the through opening. In order for the balloon-like body not to be damaged by clamping forces that are too great upon clamping, a spring 164 is provided which is supported with one end on the removable section 162 of the holding section 16 and with the other end on the clamping body 163; in this way, the clamping force is limited. With the illustrated construction, a simple exchangeability of the balloon-like body can be achieved. For exchange, first the detachable section 162 is separated from the fixedly secured section 161 of the holding section so that the spring 164 is relieved and a balloon-like body which is secured between spring 164 and through opening is released from its clamping action. The balloon-like body in the contracted state can be pulled out of the valve attachment together with the upper section 162 of the holding section 16, the pipe 3, and the clamping body 163. Subsequently, a new balloon-like body can be mounted in that the latter is pulled over the pipe 3 and the clamping body 163. The installation is realized in reverse sequence—replacement of a damaged balloon is thus easily possible.

Advantageously, the balloon-like body has such a length that it extends across the entire length of the pipe 3, through the fluid volume compensator 1', the valve attachment 2, and past it. Upon expansion of the balloon-like body not only the container to be filled/drained is lined but also the interior of the valve attachment 2 and of the volume compensator 1' so that sterile filling is enabled.

The volume compensator 1' receives the filling quantity that is displaced out of the container, usually a bottle 1, that is to be actually filled or to be drained, by the pipe 3 required for filling together with the balloon-like body 4 when both together are inserted into it. Accordingly, this liquid quantity received in the volume compensator 1' will flow down after pulling out the pipe 3 together with balloon-like body 4.

In FIG. 5, a schematic of a device is illustrated in which the filling or draining device according to the invention is used. The illustrated state is the state shortly before beginning the filling process. The balloon-like body 4 is expanded here and lines the bottle 1, the volume compensator 1' as well as the valve attachment 2. In order for liquid to flow into the bottle 1, the second structural unit 22', comprised of second housing part 22 and the component with the valve seat 8, and the third structural unit 23', comprised of the support 11 and the closure parts 9, 10 are moved upwardly in order to open the lower valve 5 (see FIG. 1*c*); this is illustrated by the arrows. In this context, it is provided that the liquid quantity to be filled in is first pre-metered by a pre-metering device 30 that comprises a piston 3β' and then pressed in by means of it. In order to prevent that return flow occurs upon pressing stroke of the piston 30', a check valve 30" is provided. Moreover, the line for the expansion medium 40 can be seen that is connected gas-tightly with the upper detachable part 162 of the holding section 16. Through this line 40, the expansion medium is discharged out of the balloon-like body 4 proportional to the filling quantity as soon as the filling process is started. The expansion medium can be pure compressed air.

In order to allow in this expanded end state inflow and outflow of fluid (air or liquid) into or out of the container along the length of the now balloon-like body (for short "balloon") in the container, the hose has at its outer side at least one, better two or even better several more, longitudinal webs whose cross-section profile can be almost arbitrary; it is only important that the longitudinal webs when the expanded hose assumes the balloon shape is supported on the container wall and a flow gap is formed from the bottom of the container upward. Upon manufacture of the hose as an extrudate, it is in particular suitable to produce the webs simply continuously. These webs have a length that extends from a lower end of the hose, which will come to rest at the bottom of the lower container to be filled, up to at least the section of the hose which is ending at the upper edge of the second valve. Accordingly, the length of the hose must be at least so long that its non-expanded section extends from the clamping action in the holding section through the valve attachment and father through optionally the fluid volume compensator and finally into a second one which is actually to be filled so that the expanded section reaches the bottom of this container.

In this context, reference is being had expressly to patent application DE 10 2012 021 775 A1 and its disclosure is incorporated herein, which discloses a distance adaptation device for such filling devices which are filled with the balloon/rod principle.

Figure 6:
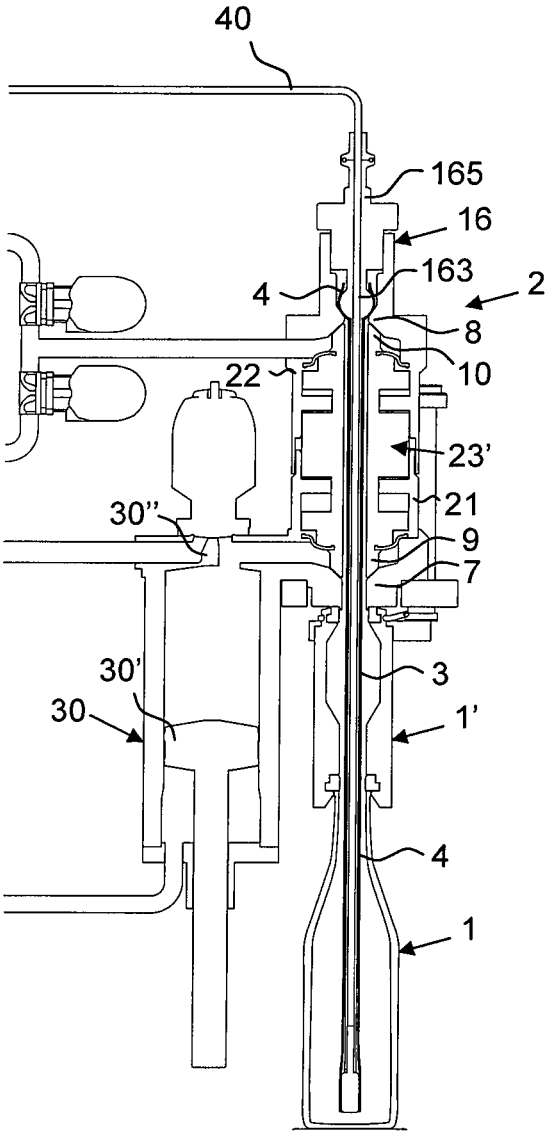
FIG. 6 a device schematic in the state after filling the container.

In FIG. 6 the state after completed filling (or before the beginning of drainage) is illustrated. The second structural unit 22' and the third structural unit 23' are in their rest position, i.e., the first valve 5 and the second valve 6 (see FIG. 1*a* to FIG. 1*c*) are closed. The bottle 1 is full and the balloon-like body 4 is contracted. However, the balloon-like body 4 and the pipe 3 displace a volume within the bottle 1 so that the filling level will drop when pulling them out of the bottle 1. In order to compensate this "loss", in the volume compensator 1' a compensation volume is made available that is matched to the dimensions of the pipe 3 and the inserted balloon-like body 4 and can flow down when pulling out the pipe 3.

LIST OF REFERENCE CHARACTERS

1 container
1' volume compensator
2 attachment
3 pipe
4 balloon-like body
5 first valve
6 second valve
7 valve seat (first valve 5)
7' annular gap of the first valve
8 valve seat (second valve 6)
8' annular gap of the second valve
9 closure part (first valve 5)
10 closure part (second valve 6)
11 support
12 annular space
13 liquid
14 bore (second valve 6)
15 bore (first valve 5)
16 holding section
161 fixedly secured lower section of the holding section
161' through opening
162 detachably connected upper section of the holding section
162' receiving bore
163 clamping body
164 spring
21 first housing part
21' first structural unit
22 second housing part
22' second structural unit
23' third structural unit

The invention claimed is:

1. A valve attachment for filling and draining a container with a liquid, the valve attachment comprising:

a first housing part and a second housing part;

a first valve comprising a first annular valve seat arranged in the first housing part and further comprising a first annular closure part matching the first annular valve seat;

a second valve comprising a second annular valve seat arranged in the second housing part and further comprising a second annular closure part matching the second annular valve seat;

the first and second annular closure parts aligned with each other along a longitudinal valve axis of the valve attachment and configured to surround a tubular element so as to form a first annular gap and a second annular gap, respectively, relative to the tubular element;

the first annular valve seat fixedly secured within the valve attachment;

the second annular valve seat slidable relative to the longitudinal valve axis;

a common support slidable along the longitudinal valve axis, wherein the first and second annular closure parts are arranged on the common support;

wherein the first housing part and the first annular valve seat form a first structural unit that is arranged at a first end of the valve attachment facing the container to be filled or drained, wherein the first end is configured to be attached seal-tightly to the container;

wherein the second housing part and the second annular valve seat form a second structural unit that is arranged at a second end of the valve attachment facing away from the container to be filled or drained;

wherein the first and second annular closure parts and the common support form a third structural unit;

wherein the first, second, and third structural units are separate from each other and are movable relative to each other in the direction of the longitudinal valve axis.

2. The valve attachment according to claim 1, wherein the first and second annular closure parts and the common support are arranged so as to be non-slidable relative to each other or are monolithically embodied.

3. The valve attachment according to claim 1, further comprising a holding section arranged on the second structural unit, wherein the holding section is configured to hold the tubular element concentrically in passages of the first and second annular closure parts.

4. The valve attachment according to claim 3, wherein the holding section comprises a lower section, fixed relative to the second structural unit and provided with a through opening for the tubular element, and further comprises an upper section, connected detachably to the lower section and provided with a bore for the tubular element, wherein the through opening is aligned with the passages of the first and second annular closure parts, and wherein the holding section comprises a clamping body seated in the through opening and supported by a spring relative to the upper section.

5. The valve attachment according to claim 1, wherein the first and second valves are conical valves.

6. The valve attachment according to claim 1, wherein at least one of the first valve and the second valve is concentrically surrounded relative to the tubular element by an annular space in which a medium can be stored.

7. The valve attachment according to claim 1, wherein the first annular closure part is sealed relative to the first structural unit by a first sealing bellows that follows a movement of the first annular closure part relative to the first structural unit, and wherein the second annular closure part is sealed relative to the second structural unit by a second sealing bellows that follows a movement of the second annular closure part relative to the second structural unit.

8. A filling or draining device for filling a container or for draining a liquid from a container, the device comprising:

a tubular element in the form of a pipe;

a balloon body;

a valve attachment comprising:

a first housing part and a second housing part;

a first valve comprising a first annular valve seat arranged in the first housing part and further comprising a first annular closure part matching the first annular valve seat;

a second valve comprising a second annular valve seat arranged in the second housing part and further comprising a second annular closure part matching the second annular valve seat;

the first and second annular closure parts aligned with each other along a longitudinal valve axis of the valve attachment and configured to surround the pipe so as to form a first annular gap and a second annular gap, respectively, relative to the pipe;

the first annular valve seat fixedly secured within the valve attachment;

the second annular valve seat slidable relative to the longitudinal valve axis;

a common support slidable along the longitudinal valve axis, wherein the first and second annular closure parts are arranged on the common support;

wherein the first housing part and the first annular valve seat form a first structural unit that is arranged at a first end of the valve attachment facing the container to be filled, wherein the first end is configured to be attached seal-tightly to the container;

wherein the second housing part and the second annular valve seat form a second structural unit that is arranged at a second end of the valve attachment facing away from the container to be filled, wherein the first and second annular closure parts and the common support form a third structural unit;

wherein the first, second, and third structural units are separate from each other and are movable relative to each other in the direction of the longitudinal valve axis, a holding section arranged on the second structural unit and configured to hold the pipe concentrically in passages of the first and second annular closure parts;

the holding section comprising a lower section, fixed relative to the second structural unit and provided with a through opening for the pipe, and further comprising an upper section, connected detachably to the lower section, wherein the through opening is aligned with the passages of the first and second annular closure parts;

wherein the pipe is arranged on the upper section of the holding section and extends, concentrically positioned, through the through opening of the lower section of the holding section and farther through the passages of the first and second annular closure parts;

wherein the pipe is configured to project into a position close to a bottom of the container in an arrangement of use of the filling or draining device;

wherein the balloon body comprises a closed end pulled over a free end of the pipe, wherein the balloon body extends through the valve attachment up to the holding section and comprises an upper end secured at the holding section.

9. The device according to claim 8, wherein the balloon body is secured in the through opening fluid-tightly by a clamping body that is supported by a spring against the upper section of the holding section, wherein a clamping pressure of the clamping body is higher than a fluid pressure.

10. The device according to claim 9, wherein the balloon body, the pipe, and the upper section of the holding section together form a detachable unit that is detachable from the valve attachment, wherein the upper section comprises a bore in which the pipe is received, and wherein the pipe extends through the bore upwardly and is received non-detachably in a fastening socket configured to be detachably coupled with a fluid source.

11. The device according to claim 9, wherein the through opening comprises an inner side with a cone tapering in a direction toward the second housing part, wherein the clamping body clamps the upper end of the balloon body relative to the cone, wherein the clamping body is a clamping ball or a clamping cone.

12. The device according to claim 9, wherein the balloon body is a hose of thermoplastic elastomeric hose material closed at a first end by an end member, preferably a cylindrical end member, preferably a cylindrical PE end member, inserted into the hose at the first end and welded to the hose material, wherein the hose comprises one or more longitudinal webs and/or one or more longitudinal grooves along a length of the hose.

13. The device according to claim 9, wherein the balloon body is formed of a non-elastomeric material and has a first lower end that is not open, wherein the balloon body comprises one or more longitudinal webs and/or one or more longitudinal grooves along a length of the balloon body.

14. The device according to claim 9, wherein the balloon body comprises a hose-shaped section comprising an inner diameter corresponding to an outer diameter of the pipe, wherein the hose-shaped section is pulled without play over the pipe, and further comprises a section that is configured to unfold to a shape so as to contact in an unfolded state an inner wall of the container.

15. A filling assembly for filling a container with a liquid or for draining a liquid from a container, the filling assembly comprising a device according to claim 8 and further comprising a fluid volume compensator, wherein the valve attachment of said device is arranged fluid-tightly on the fluid volume compensator and the fluid volume compensator is arranged fluid-tightly on the container.

16. A filling method for a container employing a device according to claim 8, the filling method comprising the steps of:

fluid-tightly arranging a container with a fill opening on the first end of the valve attachment;

inserting the pipe with the balloon body pulled over the pipe into the container;

moving upwardly the second structural unit to lift the second annular closure part off the second annular valve seat and to open the second valve;

expanding the balloon body by flowing an expansion medium into the balloon body and displacing fluid contained in the container by the expanding balloon body, wherein the fluid escapes through the open second valve;

moving upwardly by the same travel the first structural unit and the third structural unit to lift the first annular closure part off the first annular valve seat and to open the first valve while closing the second valve;

flowing filling fluid into the container via the first valve through the annular gap of the first valve;

displacing the expansion medium from the balloon body by the inflowing filling fluid until the balloon body is completely contracted;

lifting the valve attachment from the container and pulling the pipe and the balloon body out of the container.

17. The filling method according to claim 16, further comprising:

connecting a fluid volume compensator seal-tightly to the first end of the valve attachment and connecting the fill opening of the container seal-tightly to the fluid volume compensator opposite the valve attachment;

filling a compensation volume of the fluid volume compensator with the filling fluid;

when pulling out the pipe and the balloon body, allowing flow of the filling fluid contained in the compensation volume out of the fluid volume compensator into the container to compensate a displacement volume of the pipe and the balloon body.

18. A draining method for a container employing a device according to claim 8, the method comprising:

fluid-tightly arranging a container filled with a filling fluid with a fill opening at the first end of the valve attachment;

inserting the pipe with the balloon body pulled over the pipe into the container;

moving the second structural unit and the third structural unit upwardly by the same travel to lift the first annular closure part off the first annular valve seat and open the first valve;

expanding the balloon body by flowing an expansion medium into the balloon body and displacing the filling fluid out of the container, the filling fluid escaping through the annular gap of the open first valve;

moving downwardly the third structural unit to place the first annular closure part on the first annular valve seat and close the first valve and to lift the second annular closure part off the second annular valve seat and open the second valve;

allowing the expansion medium to escape from the balloon body via the second valve to contract the balloon body and compensate pressure.

19. The draining method according to claim 18, further comprising:

connecting a fluid volume compensator seal-tightly to the first end of the valve attachment and connecting the fill opening of the container seal-tightly to the fluid volume compensator opposite the valve attachment;

wherein, when expanding the balloon body, a compensation volume of the fluid volume compensator is filled with the filling fluid to be drained, and the balloon body is then allowed o expand into the compensation volume so that the filling fluid to be drained is displaced completely out of the fluid volume compensator.

* * * * *